US009423148B2

(12) United States Patent
Oakner et al.

(10) Patent No.: US 9,423,148 B2
(45) Date of Patent: Aug. 23, 2016

(54) OVERFLOW SAFETY SWITCH MOUNTING DEVICE

(71) Applicant: MSD Research, Inc., Boca Raton, FL (US)

(72) Inventors: Stuart Oakner, Boca Raton, FL (US); Donna Oakner, Boca Raton, FL (US)

(73) Assignee: MSD RESEARCH, INC., Boca Raton, FL (US)

( * ) Notice: Subject to any disclaimer, the term of this patent is extended or adjusted under 35 U.S.C. 154(b) by 0 days.

(21) Appl. No.: 14/801,084

(22) Filed: Jul. 16, 2015

(65) Prior Publication Data

US 2015/0323241 A1 Nov. 12, 2015

Related U.S. Application Data

(63) Continuation-in-part of application No. 14/615,976, filed on Feb. 6, 2015, now Pat. No. 9,217,577, which is a continuation-in-part of application No. 14/451,589, filed on Aug. 5, 2014, now abandoned, which is a continuation-in-part of application No. 13/953,948, filed on Jul. 30, 2013, now Pat. No. 8,967,183.

(60) Provisional application No. 61/716,238, filed on Oct. 19, 2012.

(51) Int. Cl.

| | |
|---|---|
| ***F16K 31/18*** | (2006.01) |
| ***F24F 13/22*** | (2006.01) |
| *F24F 11/00* | (2006.01) |

(52) U.S. Cl.

CPC ..... *F24F 13/222* (2013.01); *F24F 2011/0054* (2013.01); *F24F 2013/227* (2013.01); *Y10T 137/4245* (2015.04); *Y10T 137/4259* (2015.04)

(58) Field of Classification Search

CPC F25D 21/02; F24F 13/222; F24F 2011/0054; F24F 2013/227; Y10T 137/4245; Y10T 137/4259

USPC ..... 137/238, 240, 409, 398; 4/227.7; 62/303, 285; 340/623, 624, 625

See application file for complete search history.

(56) References Cited

U.S. PATENT DOCUMENTS 3,154,683 A * 10/1964 Blair ..... A61B 6/501 378/180
3,298,231 A * 1/1967 Zukley ..... E03D 1/32 137/426

(Continued)

FOREIGN PATENT DOCUMENTS

GB 2029197 A * 3/1980 ..... A47B 57/56

*Primary Examiner* — Kevin Murphy
*Assistant Examiner* — Minh Le
(74) *Attorney, Agent, or Firm* — Robert M. Downey, P.A.

(57) ABSTRACT

A mounting device for removably supporting an overflow safety switch in operable position within a condensation collecting drain pan in HVACR equipment. The mounting device includes a clip member that is secured to the drain pan side wall and locked in place by a non-penetrating thumb screw. A bracket removably attaches to the overflow safety switch at several adjusted positions and is slidably adjustable on the clip member for adjustably positioning the overflow safety switch relative to a bottom of the drain pan. The overflow safety switch is easily removed from the bracket for adjustment and replacement while the bracket remains fitted to the clip member. Moreover, the bracket is easily removed from the clip member without removing the clip member from the drain pan side wall.

5 Claims, 5 Drawing Sheets

(56) References Cited

U.S. PATENT DOCUMENTS 3,538,745 A * 11/1970 Ginsburgh ..... G01M 3/3245 340/623
4,108,202 A * 8/1978 Schoepe ..... F16K 31/24 137/436
4,502,515 A * 3/1985 Kobayashi ..... F04B 49/025 141/195
4,901,208 A * 2/1990 DePetro ..... B60Q 1/0683 362/419
5,816,732 A * 10/1998 Nissen ..... F16G 11/00 403/155
5,878,987 A * 3/1999 Hayde ..... A47G 1/1613 248/477
5,965,814 A * 10/1999 French ..... F24F 11/0086 307/118
6,027,086 A * 2/2000 Heitlinger ..... A47B 91/024 248/188.5
6,296,218 B1 * 10/2001 Marra ..... B63B 3/70 248/297.21
6,698,215 B2 * 3/2004 Bush ..... F24F 13/222 248/213.2
6,730,865 B1 * 5/2004 Hernandez-Zelaya . G01F 23/68 200/84 R
7,010,928 B2 * 3/2006 Spanger ..... F24F 13/222 248/229.15
7,067,750 B1 * 6/2006 Cantolino ..... H01H 35/18 200/84 R
7,710,283 B1 * 5/2010 Cantolino ..... B60H 1/3233 210/321.6
D630,709 S * 1/2011 Cantolino ..... A47B 57/56 D23/233
7,896,301 B1 * 3/2011 Cantolino ..... G01F 23/38 248/228.2
7,967,267 B1 * 6/2011 Cantolino ..... F24F 13/222 248/213.2
8,887,392 B1 * 11/2014 Xu ..... F24F 13/22 248/205.1
2005/0166613 A1 * 8/2005 Oakner ..... F24F 13/222 62/150
2006/0042918 A1 * 3/2006 Cantolino ..... H01H 35/18 200/84 R
2008/0308691 A1 * 12/2008 Greer ..... D05B 75/00 248/188.4

* cited by examiner

OVERFLOW SAFETY SWITCH MOUNTING DEVICE

This patent application is a Continuation-In-Part of patent application Ser. No. 14/615,976 filed on Feb. 6, 2015, which is a Continuation-In-Part of patent application Ser. No. 14/451,589 filed on Aug. 5, 2014, which is a Continuation-In-Part of patent application Ser. No. 13/953,948 filed on Jul. 30, 2013, now U.S. Pat. No. 8,967,183 issued on Mar. 3, 2015, which is based on provisional patent application Ser. No. 61/716,238 filed on Oct. 19, 2012.

BACKGROUND OF THE INVENTION

1. Field of the Invention

The present invention relates generally to overflow safety switches for condensation producing equipment and, more particularly, to a device for installing an overflow safety switch to the side wall of a drain pan in HVACR equipment.

2. Discussion of the Related Art

In various systems and equipment, there is a need to transfer and/or drain liquid to another location. For example, in air conditioning and refrigeration systems, condensation naturally occurs as warm, humid air passes over the exterior of the evaporator coil. Typically, the condensation drips from the evaporator coil into a condensate collection pan positioned below the evaporator coil. From the collection pan, the liquid condensate is directed through a drain line that leads to a safe discharge location, such as the exterior of a building.

Occasionally, problems can occur as a result of a failure in the normal liquid transfer or drainage system. For instance, the primary condensate collection pan in an air conditioner unit, usually made of metal materials, is susceptible to rust and corrosion. This can lead to a leak developing in the primary collection pan, causing water damage to the area below the unit. Additionally, mildew and other microbial growths, combined with dust and other particulate, accumulate in the condensate pool. Over time, this accumulation can eventually cause the drain line to become clogged. When this happens, the continually produced condensate fills within the primary condensate collection pan and eventually overflows. The overflow of condensate from a continuously running HVAC unit can cause extensive and costly damage to the interior of a building or home. This is a common problem that is well known in the industry.

To prevent overflow of the primary condensate collection pan, most building codes require a safety shut-off switch to be installed in the drain pan. The shut-off switch senses water accumulation in the primary pan and, when the water level reaches a predetermined height that is well below the height of the side walls of the pan, the shut-off switch disables the HVAC system, thereby preventing further condensate accumulation and overflow of the primary pan. A secondary or emergency overflow pan is usually installed below the primary drain pan as an additional precaution and is sized, configured and positioned to catch water that might overflow the primary condensate collection pan. This emergency overflow pan can also be fitted with a shut-off switch and/or a drain line connection.

In most instances, the overflow safety switch is mounted to the side wall of the drain pan with the use of a metal clip that has a horizontal plate, a vertical plate and an inverted U-shaped portion that is structured and disposed to slip over the top edge of the drain pan and slide down the inner and outer surfaces of the drain pan wall in frictional engagement therewith. A screw is typically used for tightly securing the clip onto the wall of the drain pan. Specifically, a screw passes through the vertical plate of the clip and at least partially into the outer surface of the drain pan wall. The overflow safety switch is attached to the horizontal plate of the mounting clip to support the overflow switch vertically within the drain pan. More particularly, the overflow safety switch has an upper tubular portion or stem that has exterior screw threads. This upper threaded stem is fitted through a circular opening in the horizontal plate and held in place by one or more nuts on the threaded stem. When the clip is installed to the side wall of the drain pan, the overflow safety switch needs to be adjusted to the lowest point in the pan (i.e., the floor of the pan) by threadably manipulating the one or more nuts on the stem. Once the mounting clip is fixed to the side wall of the drain pan, and the overflow switch is in the proper adjusted position, the one or more nuts are tightened against the horizontal plate of the clip to hold the overflow switch in the proper operative position relative to the floor of the drain pan. An example of this type of mounting clip and overflow safety switch arrangement is described and illustrated in Patent Application Publication No. US 2005/0166613 to Oakner et al.

In many instances, due to the extra work needed for properly adjusting the position of the overflow safety switch relative to the mounting clip and bottom of the drain pan, the installer will simply attach the clip and overflow switch to the side wall of the drain pan with the switch held at a position that is not low enough to sense a rise water level in the drain pan. Thus, the switch is unable to perform its intended function and the rising water level will eventually lead to an overflow of the drain pan.

Moreover, the manner in which the overflow switch is attached through the circular opening in the horizontal plate requires removal of the entire combined assembly of the mounting clip and overflow switch from the drain pan for purposes of replacement or repair of the overflow switch. Thereafter, installing a new (i.e., replacement) overflow switch on the wall of the drain pan requires another tedious adjusted procedure which, as noted above, is often overlooked. It can therefore be appreciated that the currently and extensively used mounting clip and overflow safety switch arrangement has significant limitations, including the need for time consuming and tedious installation, replacement and adjustment that can result in improper installations that render the overflow switch inoperative and thereby causing drain pan overflows and costly damage.

Accordingly, there remains a need for an improved mounting device and assembly for easily and efficiently securing an overflow safety switch to the side wall of a condensation collecting drain pan as found in HVACR equipment, and wherein the overflow switch can be easily and quickly adjusted to the proper operative position, and further wherein the overflow switch can be easily removed and replaced without removing the mounting clip from the drain pan.

OBJECTS AND ADVANTAGES OF THE INVENTION

Considering the foregoing, it is a primary object of the present invention to provide a device that allows for fast and easy mounting of an overflow safety switch to the side wall of a condensation collection drain pan without the need to screw into the wall of the pan, and wherein the safety switch can be easily removed and replaced.

It is a further object of the present invention to provide a device for mounting of an overflow safety switch to the side wall of a drain pan in HVACR equipment, and wherein the device is structured and disposed for allowing fast and easy adjustment of the height of the overflow switch within the drain pan so as to assure proper operative positioning of the overflow switch that will sense water accumulation within the drain pan and disable the HVACR equipment well before an overflow of the drain pan.

It is still a further object of the present invention to provide a device for mounting an overflow safety switch to the side wall of a drain pan in HVACR equipment and wherein the overflow switch can be easily removed and replaced without removing the mounting device from the side wall of the drain pan.

It is still a further object of the present invention to provide a device for mounting an overflow safety switch to the side wall of a drain pan in HVACR equipment without the need to screw into the side wall of the drain pan to hold the device in place.

It is yet a further object of the present invention to provide a device for mounting an overflow safety switch to the side wall of a drain pan in HVACR equipment that allows for fast and easy adjustment of the height of the overflow switch within a variety of drain pans of different depths.

It is yet a further object of the present invention to provide a device for mounting an overflow safety switch to a side wall of a drain pan in HVACR equipment, and wherein the device easily adapts to varying depth drain pans between 1.5 inches and 3 inches deep to hold a lower end of the overflow switch at the lowest point in the drain pan for optimal function.

It is still a further object of the present invention to provide a device for mounting an overflow safety switch to the side wall of a drain pan in HVACR equipment and wherein the device includes a clip portion that removably attaches to the side wall with a non-penetrating set screw and further wherein the device includes a bracket that slides within tracks on the clip and adjustably holds the overflow switch.

It is still a further object of the present invention to provide a device for mounting an overflow safety switch to the side wall of a drain pan in HVACR equipment wherein the bracket of the device includes a C-clip for holding the overflow switch and allowing removal of the overflow switch without removing the bracket from the mounting clip on the wall of the drain pan.

These and other objects of the present invention are more readily apparent with reference to the detailed description and accompanying drawings.

SUMMARY OF THE INVENTION

The present invention is directed to a device for removably mounting an overflow safety switch to the side wall of a drain pan in HVACR equipment. In one embodiment of the invention, the overflow safety switch is a float switch that has a vertically extending hollow tubular body and a buoyant annual float member that is movable along an outer surface of the tubular body between a lower stop member and an upper stop member. The mounting device of the present invention is structured for supporting the overflow safety switch in a generally vertical and upright position with a bottom end of the hollow tubular body of the float switch positioned in contact with, or just slightly above, the bottom of the drain pan. In the event water from condensation begins to accumulate in the drain pan, as a result of a clog or other obstruction in the drain line system, the buoyant annual float member rises up the hollow tubular body of the switch which causes the switch to close and interrupt operation of the HVACR equipment.

The overflow safety switch mounting device of the present invention includes a clip member that removably attaches to the side wall of the drain pan and a bracket that removably attaches to the hollow tubular body of the overflow switch at a plurality of adjusted positions. The bracket is slidably received within opposing guide tracks on the clip member for adjustably positioning the overflow safety switch relative to the bottom of the drain pan. The clip member is received over a top edge of the drain pan side wall and engages inner and outer surfaces of the drain pan side wall. A non-penetrating thumb screw (i.e., set screw) is received through an outer downwardly depending leg of the clip member for engagement with the outer surface of the drain pan side wall to effectively lock the mounting device in fixed position on the side wall of the drain pan.

The structure of the mounting device of the present invention allows the overflow safety switch and bracket to be easily removed from the clip member without removing the clip member from the side wall of the drain pan. Moreover, the overflow safety switch can be easily removed from the bracket without removing the bracket from the clip member. This allows for adjustable positioning of the overflow safety switch relative to the bracket, as well as the bottom of the drain pan. Further, the ability to easily remove the overflow safety switch from the bracket allows for easy replacement of the overflow safety switch without removing the bracket or clip member from the drain pan.

BRIEF DESCRIPTION OF THE DRAWINGS

For a fuller understanding of the nature of the present invention, reference should be made to the following detailed description taken in conjunction with the accompanying drawings in which.

Like reference numerals refer to like referenced parts throughout the several views of the drawings.

DETAILED DESCRIPTION OF THE PREFERRED EMBODIMENT

Figure 1:
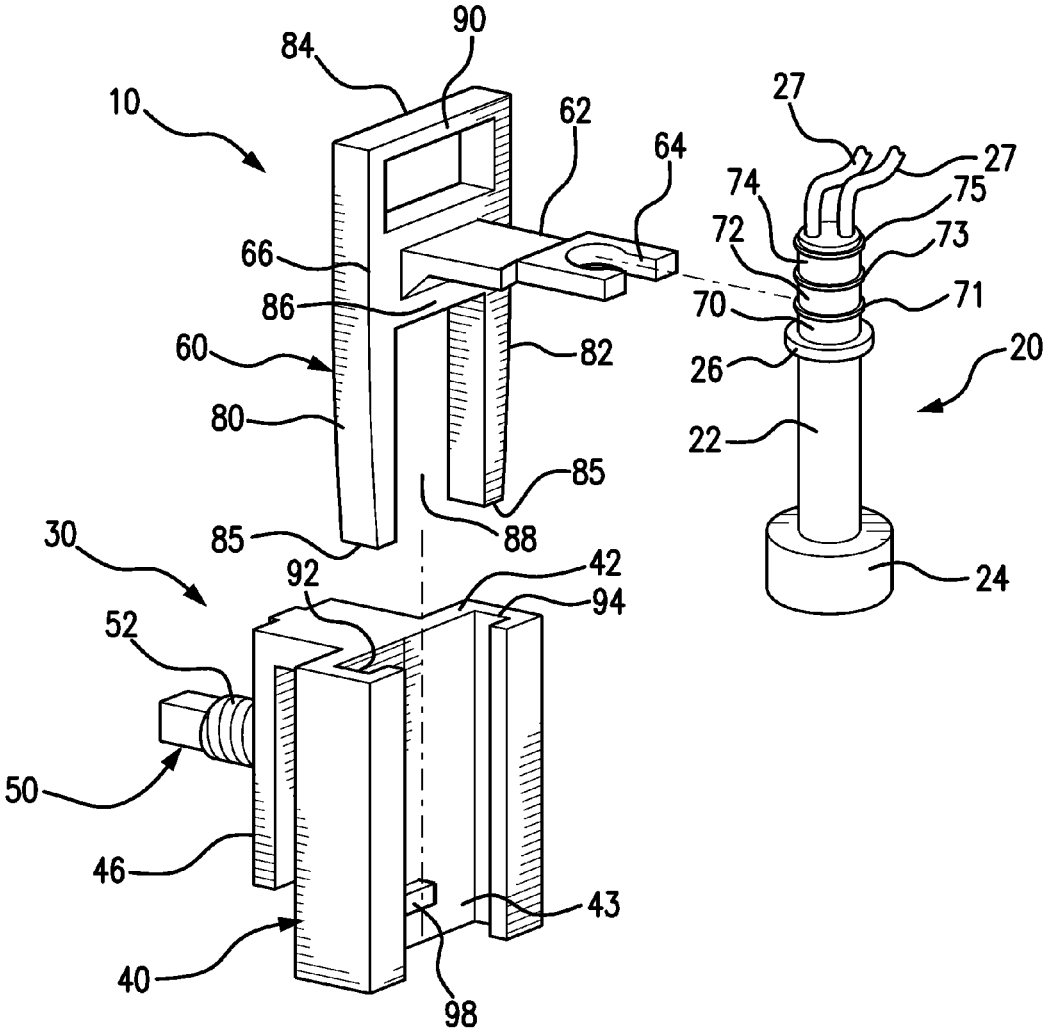
FIG. 1 is an exploded perspective view showing an overflow safety switch separated from the mounting device which includes a bracket and a clip member.

Referring to the several views of the drawings, the overflow safety switch assembly of the present invention is shown and generally indicated as 10. The overflow safety switch assembly is specifically structured for installation on a side wall 110 of a condensation collecting drain pan 100 for collecting water that drips from condensation producing equipment, particularly HVACR equipment. The overflow safety switch assembly 10 includes an overflow safety switch 20 and a mounting device 30 for removably mounting the overflow safety switch to the side wall 110 of the drain pan 100.

Figure 4:
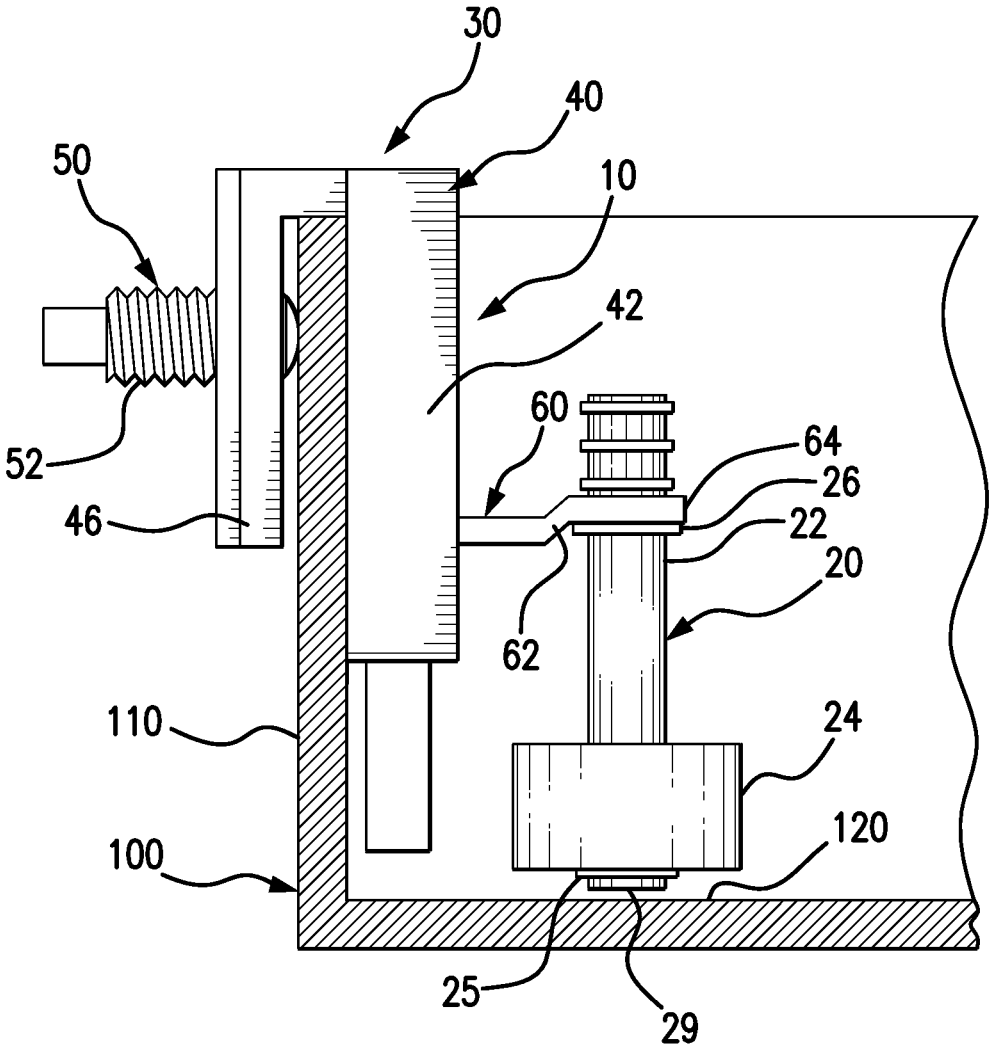
FIG. 4 is an isolated side elevational view, in partial cross-section, showing the mounting device of the present invention supporting the overflow safety switch in a correct operable position relative to the bottom of the drain pan, with no water accumulation in the drain pan.
Figure 5:
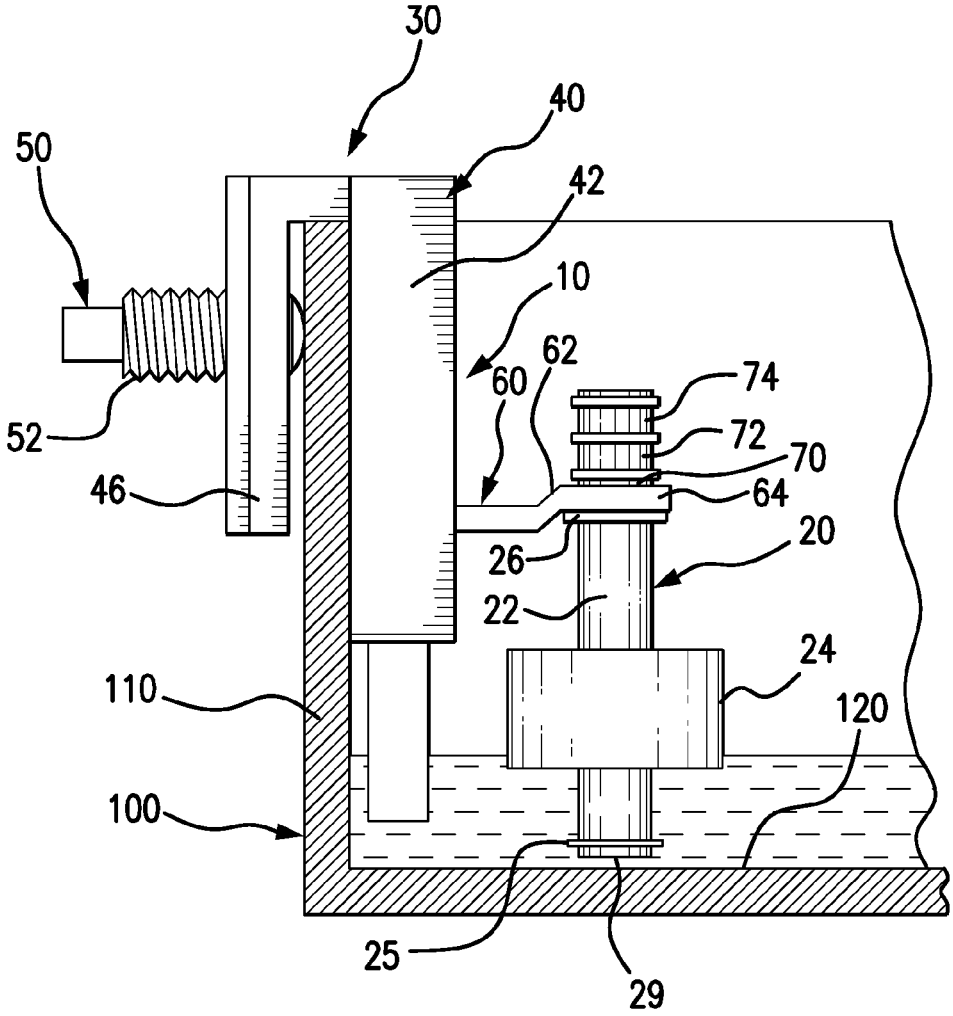
FIG. 5 is an isolated side elevational view, shown in partial cross-section, showing the mounting device holding the overflow safety switch in the same operable position as seen in FIG. 4, and wherein water has accumulated within the drain pan to cause the buoyant annular float member of the overflow safety switch to rise and operate the switch, thereby interrupting operation of HVACR equipment.

In one embodiment of the invention, the overflow safety switch 20 is a float switch that has a vertically extending hollow tubular body 22 and a buoyant annular float member 24 that is movable along an outer surface of the tubular body 22 between a lower stop member 25 and an upper stop member 26. Wire conductors 27 extend from a top end of the float switch 20 for electrical connection to the condensation producing equipment (e.g., HVACR equipment). The mounting device 30 of the present invention is structured for supporting the overflow safety switch 20 in a generally vertical and upright position with a bottom end 29 of the hollow tubular body 22 positioned in contact with, or just slightly above, the bottom 120 of the drain pan 100, as seen in FIGS. 4 and 5.

The mounting device 30 includes a clip member 40 that is structured and disposed for removable attachment to the side wall 110 of the drain pan 100. The clip member 40 includes a primary support structure 42 having a front side 43 and a back surface 44 that engages an inner surface of the drain pan side wall 110. The clip member 40 further includes an outer leg 46 extending downwardly in spaced relation to the back surface 44 of the primary support structure 42 to form a gap therebetween that is specifically sized for receipt of the side wall 110 of the drain pan 100 therebetween, as seen in FIGS. 4 and 5. A finger operated set screw 50 has exterior threads 52 and a blunt distal end 54. The set screw 50 is received through an opening 48 formed through the outer leg 46 and is threadably advanced therethrough until the blunt distal end 54 of the set screw 50 is forced into engagement with the outer surface of the drain pan side wall 110 to pinch the side wall 110 between the set screw 50 and the back surface 44 of the primary support structure 42, thereby effectively locking the clip member in fixed position on the side wall 110 of the drain pan 100, as seen in FIGS. 4 and 5. The blunt distal end 54 of the set screw 50 prevents penetration of the set screw through the drain pan side wall 110.

The mounting device 30 further includes a bracket 60 that is removably and adjustably fitted to the primary support structure 42 of the clip member 40. The bracket 60 includes an outwardly extending arm 62 with a C-clip 64 on a distal end of the arm 62 for removable attachment to the tubular body 22 of the overflow safety switch 20. An upper portion of the tubular body of the overflow safety switch has an arrangement of vertically spaced grooves (preferably three grooves) that allow for selective adjustment of the height of the overflow safety switch 20 within the drain pan 100. As seen throughout the drawing figures, in a preferred embodiment the tubular body 22 of the overflow safety switch 20 is provided with an arrangement of spaced annular rings to effectively form the grooves that receive the C-clip 64 of the bracket 60. Specifically, a first groove 70 is defined between the upper stop member and a first annular ring 71. A second groove 72 is defined between the first annular ring 71 and a second annular ring 73. A third and uppermost groove 74 is defined between annular ring 73 and a top annular ring 75. The C-clip 64 on the arm 62 of the bracket 60 is specifically structured to releasably snap into attached engagement with each of the grooves 70, 72, 74 to removably attach the overflow safety switch 20 to the bracket 60. The height of the overflow safety switch 20 relative to the bracket 60 and the bottom 120 of the drain pan 100 can be adjusted by moving the attachment of the C-clip 64 to selective ones of the plurality of grooves 70, 72 and 74. Specifically, attachment of the C-clip 64 to the first groove 70 positions the overflow safety switch 20 at the highest position relative to the bracket 60. The second groove 72 provides an intermediate height adjustment while attachment of the C-clip 64 to the third groove 74 adjustably positions the overflow safety switch 20 at the lowest position relative to the bracket 60.

The bracket 60 has a mounting member 66 that is structured and disposed for adjustably fitting to the primary support structure 42 of the clip member 40. Specifically, the mounting member 66 includes opposite side edges 80, 82 extending from a top end 84 to a bottom end 85. An upper transverse portion 86 extends between the opposite side edges 80,82. The arm 62 of the bracket 60 extends outwardly from the transverse portion 86. An open lower portion 88 below the transverse portion 86 allows the opposite side edges 80,82 to flex slightly inward at the lower portion of the mounting member when yielding to external pressure on the opposite side edges. The mounting member 66 of the bracket 60 further includes a handle 90 above the transverse portion. The primary support structure 42 of the clip member 40 includes a slot on the front side for sliding, adjustably positionable receipt of the mounting member 66 of the bracket therein, as seen in FIGS. 2-5. The slot is formed by a pair of spaced apart and opposing guide tracks 92, 94 extending vertically on the front side 43 of the primary support structure 42. The guide tracks 92, 94 are specifically sized, structured and configured for sliding, frictional engagement with the side edges 80, 82 of the bracket mounting member 66 for adjustable positioning of the bracket 60 relative to the clip member 40 and the bottom 120 of the drain pan 100. By pushing downwardly on the top handle 90 of the bracket 60, the bracket 60 is moved further down within the slot on the clip member 40 as the lower portion of the side edges 80, 82 of the bracket mounting member 66 are able to flex inwardly in response to frictional forced engagement of the guide tracks 92, 94 with the opposite side edges of the bracket mounting member. This allows the bracket 60 to be moved by sliding up or down within the slot, while remaining held in place once the desired adjusted position is achieved.

As seen in FIGS. 4 and 5, the desired adjusted position of the overflow safety switch 20 is to position the bottom end 29 of the tubular body 22 of the overflow safety switch in contact with or very close to the bottom surface 120 of the drain pan. This position allows the overflow safety switch to quickly react to accumulation of water within the drain pan. As seen in FIG. 5, as water begins to accumulate in the drain pan, the buoyant float member 24 of the float switch (i.e., overflow safety switch) begins to rise up the tubular body 22 to effectively operate the switch and interrupt operation of the condensation producing equipment and/or to operate an alarm that indicates a potential clog or obstruction in the drain line system.

Figure 2:
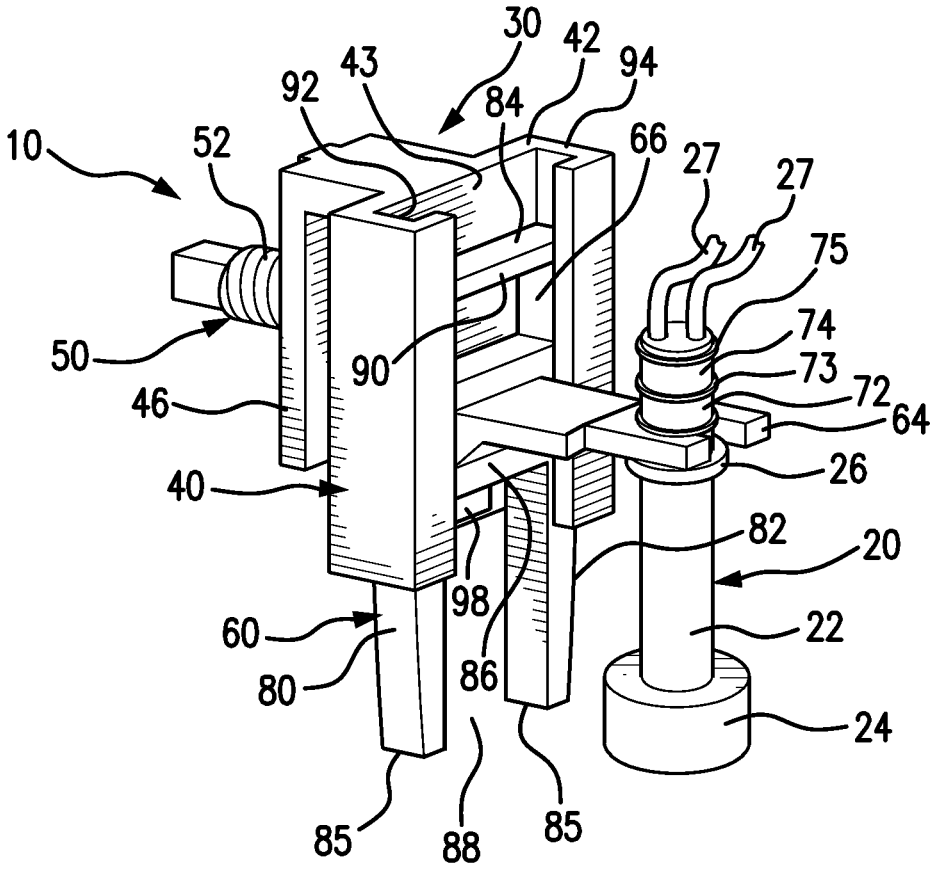
FIG. 2 is a perspective view showing the overflow safety switch attached to the bracket with the bracket received within opposing guide tracks of the clip member.
Figure 3:
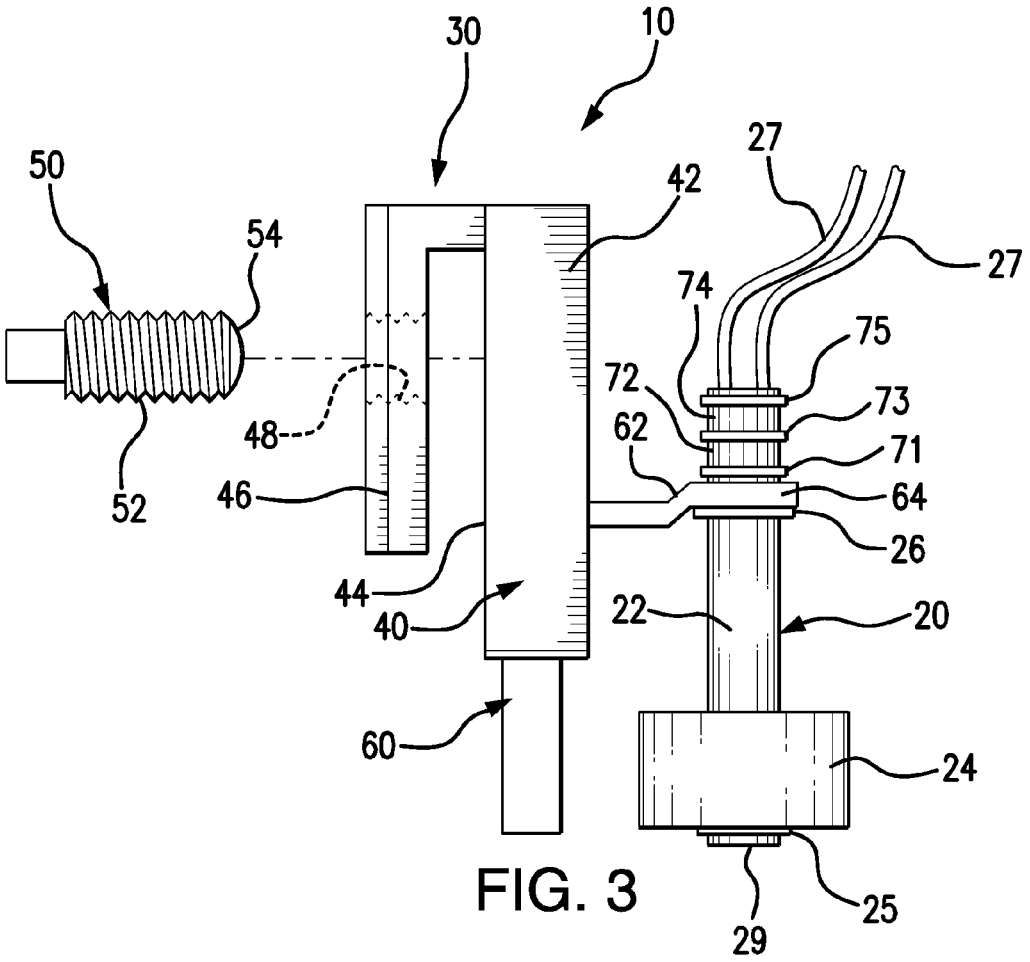
FIG. 3 is a side elevational view showing the overflow safety switch attached to the bracket with the bracket received within the opposite guide tracks of the clip member and a thumb screw separated from the clip member.

Downward adjusted movement of the bracket 60 within the guide tracks 92, 94 on the clip member is limited by a stop member 98 that protrudes from the front wall surface of the primary support structure on the clip member. Specifically, continued downward adjusted movement of the bracket 60 within the clip member 40 will eventually result in abutting engagement of the stop member 98 with a bottom edge of the transverse portion 86 on the bracket 60, thereby preventing further downward movement of the bracket 60, as seen in FIG. 2.

The ability to adjust the height of the overflow safety switch 20 by sliding the bracket 60 downwardly or upwardly relative to the clip member 40, and further by changing position of the attachment of C-clip 64 to any one of the plurality of grooves 70, 72 or 74, allows the overflow safety switch assembly 10 of the present invention to be installed on a wide variety of size drain pans having varying side wall heights. In the HVACR industry, typical drain pan side walls range in height from between 1.5 inches to 3 inches. The overflow safety switch assembly 10 of the present invention allows for easy adjusted installment of the overflow safety switch 20 to these varying depth drain pans with minimal time and effort, thereby ensuring that the overflow safety switch 20 is properly positioned to immediately sense undesirable water accumulation in the drain pan before an overflow occurs.

While the present invention has been shown and described in accordance with a preferred and practical embodiment thereof, it is recognized that departures from the instant disclosure are fully contemplated within the spirit and scope of the present invention which are not to be limited except as defined in the following claims, as interpreted under the Doctrine of Equivalence.

What is claimed is:

1. An overflow safety switch assembly for installation on a side wall of a condensation collecting drain pan, said assembly comprising:

an overflow safety switch structured and disposed for operating in response to a rise of water level within the condensation collecting drain pan, and the overflow safety switch including a tubular body with a bottom end and an upper portion;

a mounting device for removably and adjustably supporting the overflow safety switch within the drain pan so that the overflow safety switch is operated in response to a rise of water level within the drain pan before the water overflows from the drain pan; and the mounting device including:

a clip member structured and disposed for removable attachment to the side wall of the drain pan and including a primary support structure having a front side and a back surface for engaging an inner surface of the drain pan side wall, and the clip member further including an outer leg extending downwardly in spaced relation to the back surface of the primary support structure, and the outer leg being structured and disposed to be positioned on an exterior side of the drain pan side wall with the drain pan side wall sandwiched between the primary support structure and the outer leg, and the outer leg having an opening formed therethrough;

the clip member further including a non-penetrating set screw having a distal end and exterior screw threads for threaded engagement with the opening in the outer leg to allow threaded advancement of the set screw through the outer leg and into forced engagement with the exterior surface of the drain pan side wall to releasably lock the clip member onto the drain pan side wall;

a bracket removably and adjustably fitted to the primary support structure of the clip member and including an outwardly extending arm with a C-clip on a distal end of the arm for removable and adjustable attachment to the upper portion of the tubular body of the overflow safety switch, and the bracket including a mounting member for removable and adjustable fitted receipt on the primary support structure of the clip member;

the primary support structure of the clip member including a slot for sliding, adjustably positionable receipt of the bracket mounting member therein, and the slot is at least partially formed by a pair of spaced apart and opposing guide tracks extending vertically on the front side of the primary support structure;

the bracket mounting member including opposite side edges extending from a top end to a bottom end, an upper transverse portion and an open lower portion below the transverse portion and between the side edges;

the guide tracks on the primary support structure of the clip member being sized, structured and configured for sliding, frictional engagement with the side edges of the bracket mounting member for adjustable positioning of the bracket relative to the clip member and a bottom of the drain pan; and the upper portion of the tubular body of the overflow safety switch including a plurality of vertically spaced grooves for selected, adjusted attachment of the C-clip within any of the plurality of grooves, thereby allowing adjustable positioning of the overflow safety switch relative to the bracket and the bottom of the drain pan.

2. The assembly as recited in claim 1 wherein the bracket further includes a handle for grasping the bracket and adjustably moving the bracket relative to the clip member and for removing and replacing the bracket on the clip member.

3. The assembly as recited in claim 1 further comprising:

a stop member for limiting downward movement of the bracket within the slot of the primary support structure of the clip member.

4. An overflow safety switch assembly for installation on a side wall of a condensation collecting drain pan, said assembly comprising:

an overflow safety switch structured and disposed for operating in response to a rise of water level within the condensation collecting drain pan, and the overflow safety switch including a tubular body with a bottom end and an upper portion;

a mounting device for removably and adjustably supporting the overflow safety switch within the drain pan so that the overflow safety switch is operated in response to a rise of water level within the drain pan before the water overflows from the drain pan; and the mounting device including:

a clip member structured and disposed for removable attachment to the side wall of the drain pan and including a primary support structure having a front side and a back surface for engaging an inner surface of the drain pan side wall, and the clip member further including an outer leg extending downwardly in spaced relation to the back surface of the primary support structure, and the outer leg being structured and disposed to be positioned on an exterior side of the drain pan side wall with the drain pan side wall sandwiched between the primary support structure and the outer leg;

a bracket removably and adjustably fitted to the clip member and being structured and disposed for removable and adjustable attachment to the overflow safety switch, and the bracket including an outwardly extending arm with a C-clip on a distal end of the arm for removable and adjustable snap-fit attachment to the upper portion of the tubular body of the overflow safety switch, and the bracket further including a mounting member for removable and adjustable fitted receipt on the primary support structure of the clip member;

the primary support structure of the clip member including a slot for sliding, adjustably positionable receipt of the bracket mounting member therein, and wherein the slot is at least partially formed by a pair of spaced apart and opposing guide tracks extending vertically on the front side of the primary support structure;

the bracket mounting member including opposite side edges extending from a top end to a bottom end, an upper transverse portion and an open lower portion below the transverse portion and between the side edges; and the guide tracks on the primary support structure of the clip member being sized, structured and configured for sliding, frictional engagement with the side edges of the bracket mounting member for adjustable positioning of the bracket relative to the clip member and a bottom of the drain pan; and the upper portion of the tubular body of the overflow safety switch including a plurality of vertically spaced grooves for selected, adjusted snap-fit attachment of the C-clip within any of the plurality of grooves, thereby allowing adjustable positioning of the overflow safety switch relative to the bracket and the bottom of the drain pan.

5. The assembly as recited in claim 4 further comprising:

a stop member for limiting downward movement of the bracket within the slot of the primary support structure of the clip member.

* * * * *